US009562312B2

(12) United States Patent
Kim et al.

(10) Patent No.: US 9,562,312 B2
(45) Date of Patent: Feb. 7, 2017

(54) LAUNDRY TREATING APPARATUS

(71) Applicant: LG ELECTRONICS INC., Seoul (KR)

(72) Inventors: Jinwoong Kim, Seoul (KR); Hyundong Kim, Seoul (KR); Kyeonghwan Kim, Seoul (KR); Hyunseok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 284 days.

(21) Appl. No.: 14/190,248

(22) Filed: Feb. 26, 2014

(65) Prior Publication Data

US 2015/0020554 A1 Jan. 22, 2015

(30) Foreign Application Priority Data

Jul. 16, 2013 (KR) ..... 10-2013-0083723

(51) Int. Cl.

*D06F 37/20* (2006.01)
*D06F 37/22* (2006.01)
*D06F 37/26* (2006.01)

(52) U.S. Cl.

CPC ..... *D06F 37/22* (2013.01); *D06F 37/203* (2013.01); *D06F 37/225* (2013.01); *D06F 37/267* (2013.01); *D06F 37/269* (2013.01)

(58) Field of Classification Search

CPC ..... D06F 37/22; D06F 37/203; D06F 37/225; D06F 37/267; D06F 37/269
USPC ..... 68/23.1, 139, 140
See application file for complete search history.

(56) References Cited

U.S. PATENT DOCUMENTS

2012/0006067 A1 1/2012 Lim et al.

FOREIGN PATENT DOCUMENTS

| | | | | |
|---|---|---|---|---|
| CN | 102301058 A | | 12/2011 | |
| CN | 102439213 A | | 5/2012 | |
| DE | 2527185 A1 | | 1/1976 | |
| DE | 3427839 A1 | | 2/1985 | |
| GB | 2145744 A | * | 4/1985 | ..... D06F 37/22 |
| JP | 2009-153651 A | | 7/2009 | |

(Continued)

OTHER PUBLICATIONS

Chinese Office Action dated Dec. 16, 2015 issued in Application No. 201410057999.3 (with English translation).

(Continued)

*Primary Examiner* — Michael Barr
*Assistant Examiner* — Levon J Shahinian
(74) *Attorney, Agent, or Firm* — KED & Associates, LLP

(57) ABSTRACT

A laundry treating apparatus may include a tub, a drum, a driving system including a bearing housing and a driving motor for rotating a rotation shaft of the drum, supporting devices extending between a lower surface of the cabinet and the bearing housing, and a plurality of dampers installed between the supporting devices and the lower surface of the cabinet. The plurality of dampers may include first dampers extending inward from a front portion of the supporting devices toward the lower surface of the cabinet, and second dampers extending downward from the supporting devices toward the rear side of the cabinet. This arrangement may prevent vibration generated during rotation of the drum from being transferred to the tub, and thus an additional component for reducing vibration of the tub may not be required. Thus, the laundry treating apparatus may have a larger capacity within a fixed size of cabinet.

18 Claims, 8 Drawing Sheets

(56) References Cited

FOREIGN PATENT DOCUMENTS

WO WO 2010/077056 A2 7/2010

OTHER PUBLICATIONS

European Search Report dated Nov. 25, 2014 issued in application No. 14154084.9.

* cited by examiner

LAUNDRY TREATING APPARATUS

CROSS-REFERENCE TO RELATED APPLICATION(S)

This application claims priority under 35 U.S.C. §119 to Korean Application No. 10-2013-0083723 filed in Korea on Jul. 16, 2013, whose entire disclosure is hereby incorporated by reference.

BACKGROUND

1. Field

This relates to a vibration reducing device for a laundry treating apparatus.

2. Background

In general, laundry treating apparatuses, such as washing machines, washing machines also having a drying function, or drying machines, may include a drum in which laundry items are received. The washing machine, or combination washing and drying machine, may also include a tub surrounding the drum for storing washing water, with the drum rotatably installed within the tub.

BRIEF DESCRIPTION OF THE DRAWINGS

The embodiments will be described in detail with reference to the following drawings in which like reference numerals refer to like elements wherein.

DETAILED DESCRIPTION

Hereinafter, various embodiments will be described in detail with reference to the accompanying drawings. In describing the embodiments, some detailed description may be omitted when pertinent technologies may be understood by one of ordinary skill. Further scope of applicability of the embodiments will become more apparent from the detailed description given hereinafter. However, it should be understood that the detailed description and specific examples, while indicating various embodiments, are given by way of illustration only, since various changes and modifications within the spirit and scope as broadly described herein may be possible.

Figure 1:
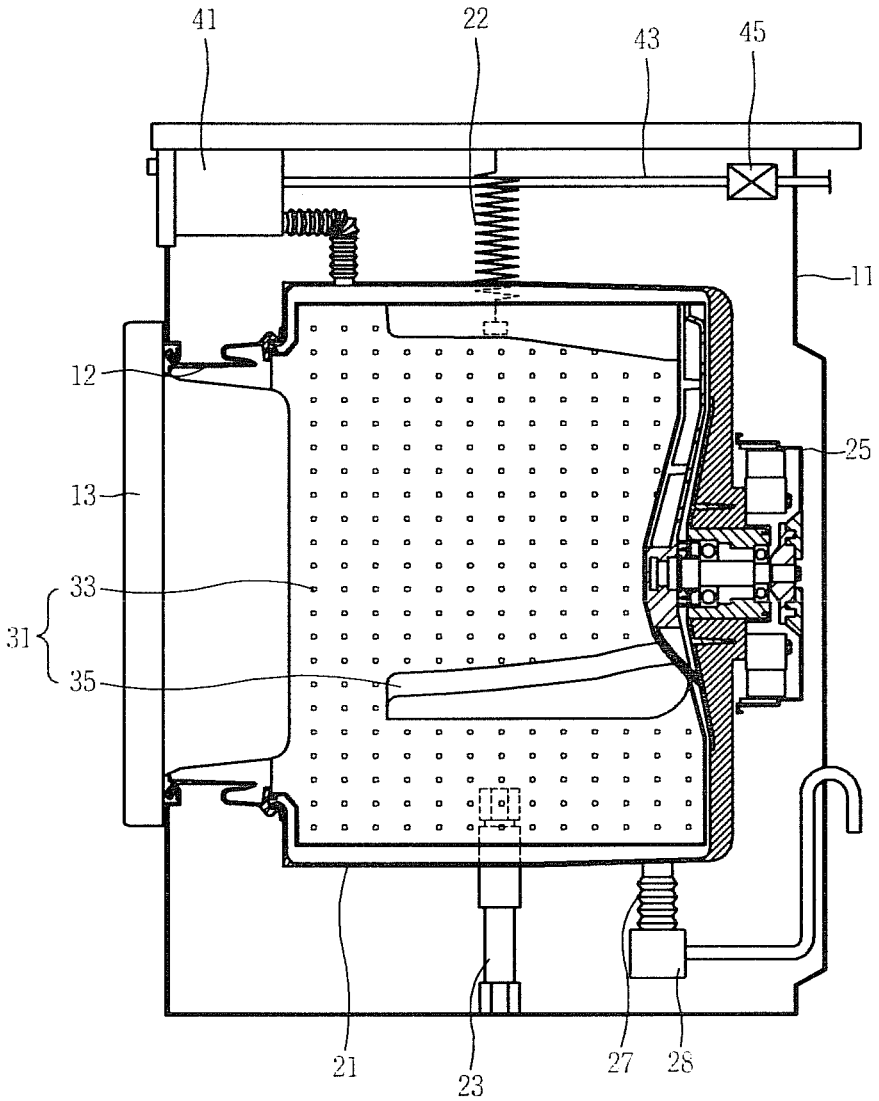
FIG. 1 is a side sectional view of an exemplary washing machine.

A side sectional view of an exemplary laundry treating apparatus, in particular, a washing machine, is shown in FIG. 1. The washing machine may include a cabinet 11, a tub 21 received within the cabinet 11, and a drum 31 rotatably installed within the tub 21. An opening 12 and a door 13, through which laundry items may be introduced into and removed from the drum 31, may be provided on a front surface of the cabinet 11. The tub 21 may be supported within the cabinet 11 a spring 22 and a damper 23. The tub 21 may have a cylindrical shape having one end open, and the drum 31 may be rotatably installed within the tub 21. The drum 31 may have a cylindrical shape with an open front end. The drum 31 may include a plurality of through holes 33 formed in a circumferential surface thereof. A plurality of lifts 35 for lifting the laundry items may be installed on an inner surface of the drum 31. A driving motor 25 for rotating the drum 31 may be coupled to a rear portion of the tub 21. A drain passage 27 and a drain pump 28 may be disposed below the drum 31 to discharge water therethrough. A detergent injector 41 for supplying detergent may be disposed above the tub 21. A water supply pipe 43 may be connected to the detergent injector 41. A water supply valve 45 may be disposed on the water supply pipe 43.

In the exemplary washing machine shown in FIG. 1, vibration generated due to rotation of the drum 31 by the driving motor 25 may be transferred to the tub 21. Accordingly, the tub 21 may be supported by the spring 22 and the damper 23 for absorbing the vibration of the tub 21. In certain embodiments, separate buffering member for absorbing the vibration of the drum 31 may also be provided. However, connecting the buffering member to the drum 31 or the tub 21 may impact the size/capacity of the drum 31 and/or the tub 21 due to the installation space required to accommodate the buffering member.

The exemplary embodiment illustrated in FIGS. 2 to 8 is a washing machine including a drying function, but embodiments are not limited to this type of laundry treating apparatus. Features as embodied and broadly described herein may also be applied other types of treating apparatuses, for example, a drying machine or a washing machine, in which vibration is generated while a drum is rotated.

A laundry treating apparatus according to one exemplary embodiment as broadly described herein may include a tub 115 fixedly supported in a cabinet. The tub 115 may include an introduction opening at a front end thereof to allow laundry items to be introduced into and drawn out therethrough, and may store washing water during a washing cycle. The tub 115 may include a front part 100, or a front section 100, forming a front portion of the tub 115 and a rear part 120, or a rear section 120, forming a rear portion of the tub 115.

The front part 100 and the rear part 120 may be coupled to each other by, for example, screws, and define therein a space for accommodating a drum 300. The rear part 120 may be formed in a cylindrical shape to surround the drum 300. The rear part 120 may have an open front end and have an annular rear surface 128 in a shape of a ring. The front end of the rear part 120 may be coupled to the front part 100, and sealed.

In such a washing machine with a drying function, the rear part 120 may include a hot air outlet 121 and cooling water injection openings 122 through which cooling water is supplied into the tub 115. Alternatively, a laundry treating apparatus merely having a washing function may not include the hot air outlet 121 and the cooling water injection openings 122. The rear part 120 of the tub 115 may also include a plurality of coupling elements to fix the tub 115 in the cabinet.

An inner circumference of the rear surface 128 of the rear part 120 of the tub 115 may be coupled to an outer circumference of a rear gasket 250. An inner circumference of the rear gasket 250 may be coupled to a tub back 130, or tub rear wall 130. The tub back 130 may include a through hole formed through its central portion such that a rotation shaft may be inserted therethrough. The rear gasket 250 may be made of a material with flexibility to prevent vibration of the tub back 130 from being transferred to the rear part 120 of the tub 115.

The rear gasket 250 may be hermetically coupled to the tub back 130 and the rear part 120 to prevent a leakage of washing water from the tub 115. The tub back 130 may vibrate with the drum 300 when the drum 300 is rotated. The tub back 130 may be spaced apart from the rear part 120 of the tub 115 with a sufficient gap so as avoid interference with the rear part 120. The rear gasket 250 may be made of a flexible material so as to allow the tub back 130 to be relatively movable without interference with the rear part 120. The rear gasket 250 may include, for example, a bellows portion which extends long enough to allow for the relative motion of the tub back 130.

The drum 300 may be accommodated in the tub 115 and rotatably coupled to the rear end of the tub 115. The drum 300 may include, for example, ball balancers installed on front and rear portions thereof. The rear portion of the drum 300 may be connected to a spider 350, which may be connected to a rotation shaft 351. The drum 300 may be rotatable within the tub by a rotational force transferred from the rotation shaft 351. Lifts in the drum 300 are designated with reference numerals 311, 312.

The rotation shaft 351 may be connected to a driving motor 500 through the tub back 130, for example, in a direct coupled manner. In detail, the rotation shaft 351 may be connected directly to a rotor of the driving motor 500. A bearing housing 400 may be coupled to a rear surface of the tub back 130. The bearing housing 400 may rotatably support the rotation shaft 351 between the driving motor 500 and the tub back 130.

A stator of the driving motor 500 may be fixed to the bearing housing 400 and surrounded by the rotor of the driving motor 500. The driving motor 500 may be, for example, an outer rotor type, and may be directly connected to the rotation shaft 351.

The bearing housing 400 may be supported by a suspension device from a base 600 which defines a lower surface of the cabinet. The suspension device may include supporting members connected to the bearing housing 400, and a plurality of dampers and elastic members installed between the supporting members and the base 600. The suspension device may be symmetrically arranged, based on a position of the rotation shaft 351 of the drum 300.

The supporting members may be connected to the bearing housing 400, and connected to the tub back 130 from the rear of the tub 115 through the bearing housing 400. The supporting members may extend toward the base 600 from the rear of the tub 115. For example, the supporting members may extend toward a side of the cabinet so as to be inclined with respect to the base 600. In certain embodiments, the supporting members, which extend downward from the rear of the tub 115 may then be bent toward the front of the cabinet and extend to the base 600.

The supporting members may be symmetrically disposed on left and right sides of a vertical centerline based on the rotation shaft 351 of the drum 300. The left and right supporting members may include first brackets 710*a* and 710*b* and second brackets 730*a* and 730*b*. The left supporting member and the right supporting member may be symmetrical to each other. Hereinafter, description will be provided based on the left supporting member, positioned with respect to the rotation shaft 351 of the drum 300.

The first bracket 710*a* may be connected to a bracket connection portion 410*a* of the bearing housing 400. The first bracket 710*a* may extend from the rear of the tub back 130 toward the base 600 at an incline, and then extend between the tub and the base 600 in a bending manner. Also, the first bracket 710*a* may get narrower in width from its upper portion to its lower portion. That is, a width of an upper portion of the first bracket 710*a* may be greater than a width of a lower portion of the first bracket 710*a*.

The upper portion of the first bracket 710*a* may include a plurality of coupling holes to be coupled with the bracket connection portion 410*a* of the bearing housing 400. The first bracket 710*a* may further include damper coupling portions 714 formed on an upper right side thereof and hinge-coupled with a third damper 780*a* to be explained later. The damper coupling portions 714 may laterally protrude from the upper right side of the first bracket 710*a* and may have hinge coupling holes formed thereth roug h.

A bent portion 713 forming a lower portion of the first bracket 710*a* may be connected to the second bracket 730*a*, and coupled with a weight (or weight body) 750*a*. The bent portion 713 forming the lower portion of the first bracket 710*a* may have at least four through holes, for calking.

The first bracket 710*a* may further include side walls 711 and 712 and a pair of beads 715 for ensuring rigidity to stably support the drum 300. The side walls 711 and 712 formed on two opposite side ends of the first bracket 710*a* in a widthwise direction may increase in height from an upper portion to a lower portion of the first bracket 710*a*. The beads 715 may be located between the upper portion of the first bracket 710*a* and the bent portion 713. The pair of beads 715 may be formed in parallel to each other by extending along the longitudinal direction of the first bracket 710*a*. The shape of the bead may have any shape that satisfies rigidity required.

The first bracket 710*a* may be molded in a pressing manner to form the side walls 711 and 712 and the beads 715. The second bracket 730*a* may also be formed by press-molding, and made of the same material as the first bracket 710*a*.

The second bracket 730*a* may extend between the tub 115 and the base 600 from the first bracket 710*a* toward the front of the cabinet. The second bracket 730*a* may get narrower from a back end to a front end thereof. That is, a width of a rear end portion of the second bracket 730*a*, which is a portion coupled with the first bracket 710*a*, may be greater than a width of a front end portion of the second bracket 730*a*.

The rear end portion of the second bracket 730*a* may be connected to the bent portion 713 of the first bracket 710*a* by, for example, caulking, and the caulking may be applied on at least four connection points. Here, the coupling method may not be limited to this. They may also be coupled by coupling members, such as bolts and the like, or the coupling members caulking may be used together.

The front end portion of the second bracket 730*a* may be elastically supported by a front elastic member 740*a* (see FIG. 5), and a central portion thereof may be elastically supported by a second damper 770*a*. A first damper 760*a* (see FIGS. 2 and 4) may elastically support the second bracket 730*a* between the front end portion and the central portion of the second bracket 730*a*. A rear end portion of the second bracket 730*a* may be elastically supported by a rear elastic member 720*a* (see FIG. 2). To this end, the second bracket 730*a* may further include a front spring holder 701*a* (see FIGS. 2 and 5) for connecting the front elastic member 740*a* to the second bracket 730*a*, a damper holder 702*a* (see FIGS. 2 and 5) for connecting the first damper 760*a* and the second damper 770*a* (see FIGS. 2 and 4) to the second bracket 730*a*, and a rear spring holder 703*a* (see FIG. 7) for connecting the rear elastic member 720*a* to the second bracket 730*a*. The second bracket 730*a* may further include a plurality of coupling holes, so as to be coupled to the front spring holder 701*a* and the damper holder 702*a* by, for example, bolts. The rear spring holder 703*a* may be coupled to a lower surface of the weight 750*a*.

Figure 4:
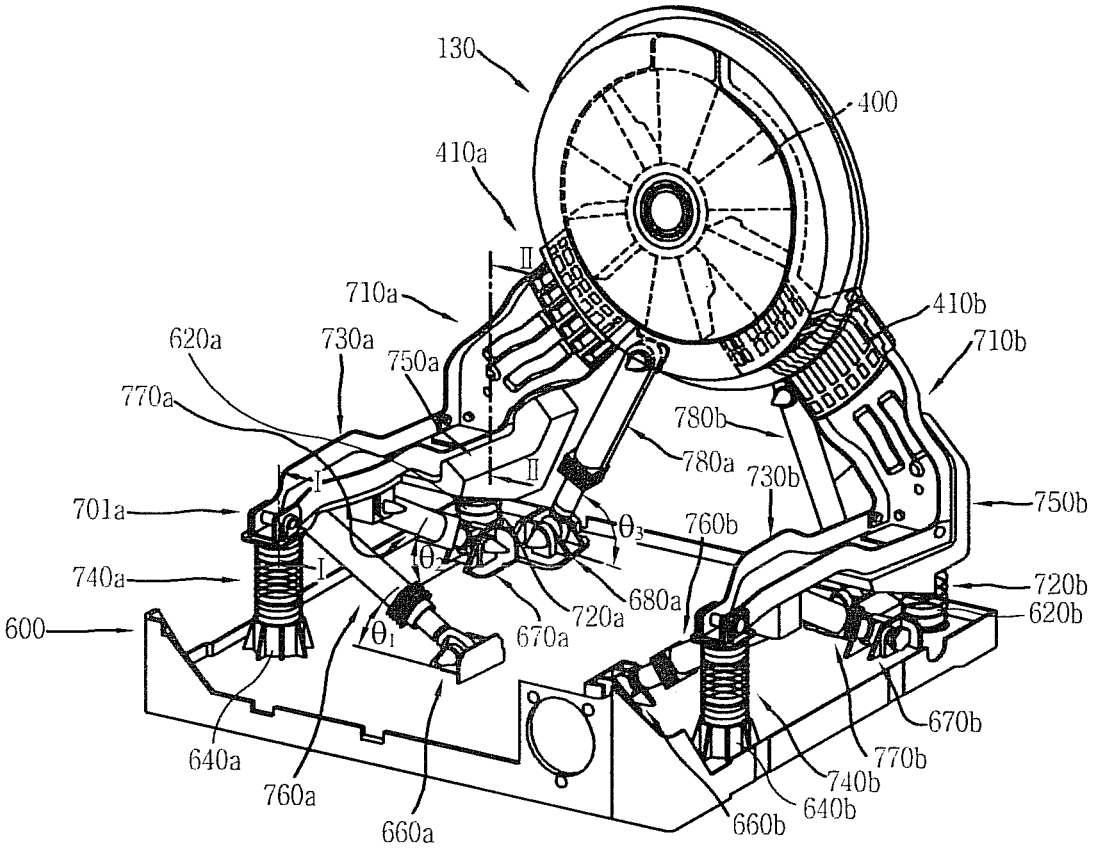
FIG. 4 is a perspective view of a support structure of the laundry treating apparatus shown in FIG. 2.
Figure 5:
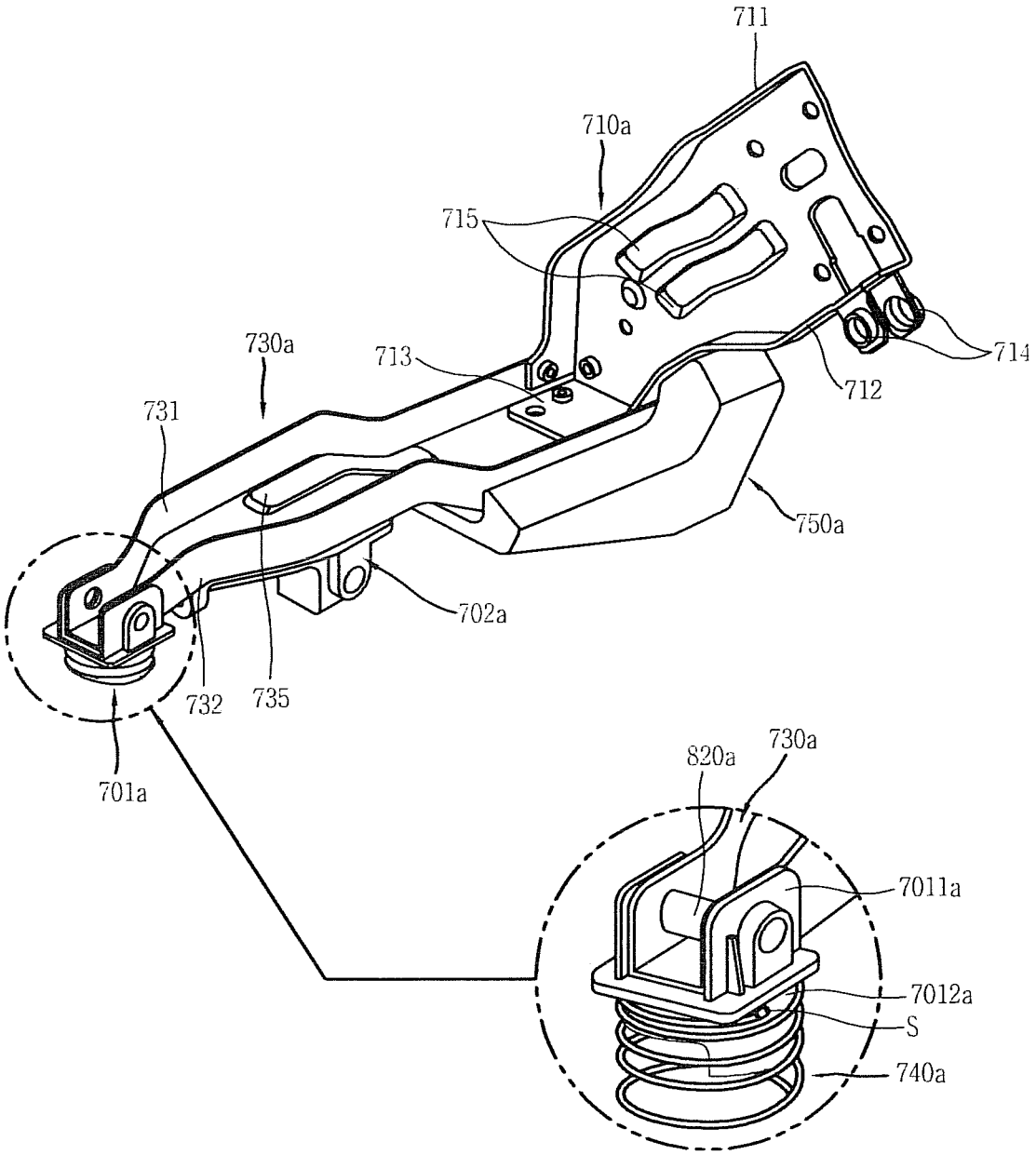
FIG. 5 is a perspective view of a supporting member shown in FIG. 4.
Figure 6:
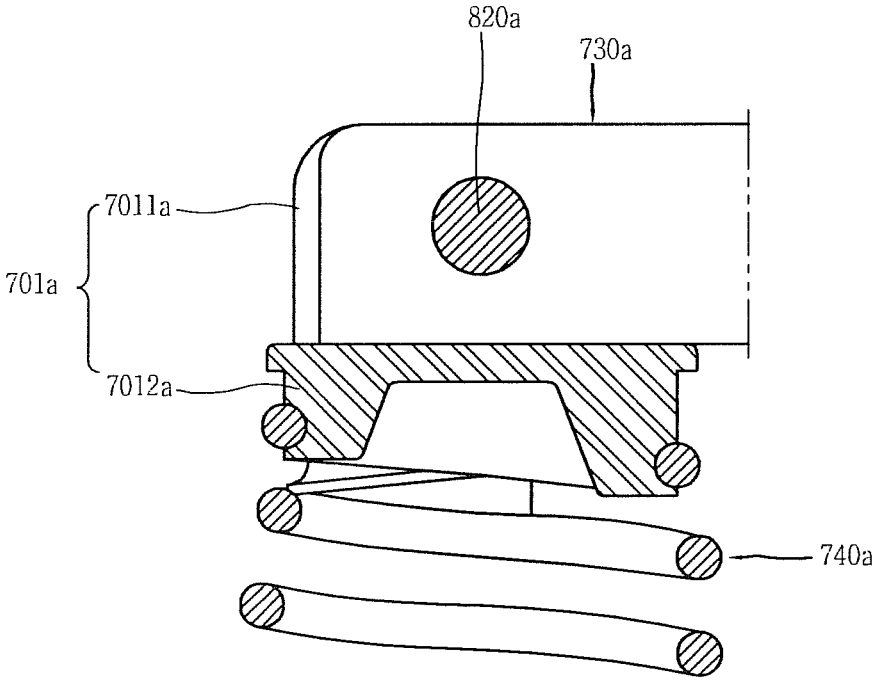
FIG. 6 is a sectional view taken along the line I-I of FIG. 4.

Referring to FIGS. 4 to 6, the front spring holder 701*a* may include an upper portion 7011*a* coupled to the front end portion of the second bracket 730*a* by a bolt 820*a*, and a lower portion 7012*a* coupled with and inserted in the front elastic member 740*a*. The upper portion 7011*a* of the front spring holder 701*a* may have a squared "U" which comes in contact with a lower surface of the front end portion and both side wall surfaces of the second bracket 730*a*. The lower portion 7012*a* of the front spring holder 701*a* may have an approximately cylindrical shape with a cavity. Also, the lower portion 7012*a* of the front spring holder 701*a* may have a thread on an outer surface thereof, such that the front elastic member 740*a* may be thereby coupled to the lower portion 7012*a* of the front spring holder 701*a*. A stopper S may protrude from an end of the thread to block an end of the front elastic member 740*a*.

A pair of elastic members may elastically support the two opposite and portions of the second bracket 730*a*. The pair of elastic members may include the front elastic member 740*a* and the rear elastic member 720*a*. The front elastic member 740*a* and the rear elastic member 720*a* may be, for example, springs and extend upward from the base 600. The spring used as the elastic member may have an outline similar to a ring or a pot when viewed from a side. For example, referring to FIG. 6, the spring used as the elastic member may have an end portion coupled to the lower portion 7012*a* of the front spring holder 701*a* that has a small diameter, which gradually increases as it extends toward the base 600. Since the diameter of the elastic member gradually increases toward the base, even when the elastic member is deformed due to vibration generated upon rotation of the drum, the lower portion 7012*a* of the front spring holder 701*a* and the spring do not crash against each other, thereby preventing the generation of noise.

The elastic members may be disposed at right and left sides based on the centerline defined by the rotation shaft of the drum 300, to elastically support the drum 300 and various components connected to the drum 300 at, for example, four points, to provide complete and balanced support. In detail, the front elastic members 740*a* and 740*b* may be disposed at right and left sides, respectively, and the rear elastic members 720*a* and 720*b* may also be disposed at right and left sides, respectively. Elastic member fixing portions 620*a*, 620*b*, 640*a* and 640*b* may each protrude from the base 600 to fix the elastic members 720*a*, 720*b*, 740*a* and 740*b* to the base 600, respectively.

The rear end portion of the second bracket 730*a*, as aforementioned, may be coupled to the first bracket 710*a*, and a lower portion of the second bracket 730*a* may be coupled with the weight 750*a*. The rear elastic member 720*a* may be located between the weight 750*a* and the base 600 to elastically support the first bracket 710*a*, the second bracket 730*a* and the weight 750*a*.

The second bracket 730*a* may further include side walls 731 and 732 and a bead 735 which are formed to provide rigidity for stably supporting the drum 300. The side walls 731 and 732 may be formed along both side edges of the second bracket 730*a*, extending longitudinally along the second bracket 730*a*. The front end portion of the second bracket 730*a* may be wider than the rear end portion thereof. The bead 735 which extends in the longitudinal direction of the second bracket 730*a* may be formed between the front end portion and the rear end portion of the second bracket 730*a*. The second bracket 730*a* may be bent into an arcuate shape with a flat upper portion between the front end portion and the central portion, thereby forming a space for connecting the first damper 760*a* and the second damper 770*a* to the second bracket 730*a*. The damper holder 702*a* may be coupled to the lower surface of the second bracket 730*a*, for example, by a bolt.

The damper holder 702*a* may include an upper plate coupled to the lower surface of the second bracket 730*a* by, for example, bolts, and a damper connecting portion protruding downward from the upper plate and having a coupling hole for coupling with dampers by hinges. The damper connecting portion may be coupled to the first damper 760*a* and the second damper 770*a*, respectively, by hinges.

Each of weights the 750*a* and 750*b* may be, for example, an L-shaped block which extends forward and upward in such a manner of covering the bent portion 713 of the supporting member. The weight may be, for example, concrete, or any other material which can provide a weight heavy enough to balance the center of mass such that the drum 300 is not biased. The weights may also be symmetrical to each other in right and left directions based on the vertical centerline defined by the rotation shaft of the drum. Hereinafter, description will be given based on the left-hand side weight.

The weight 750*a* may be formed into a shape capable of receiving a connected portion between the first bracket 710*a* and the second bracket 730*a* and covering a rear surface of the first bracket 710*a* and a lower surface of the second bracket 730*a*. Also, the weight 750*a* may have a surface, which comes in contact with the first and second brackets 710*a* and 730*a*, which is recessed to cover a part of the right side wall 712 of the first bracket 710*a* and a part of the right side wall 732 of the second bracket 730*a*. However, the weight may also be attached to either the first bracket 710*a* or the second bracket 730*a*.

Figure 2:
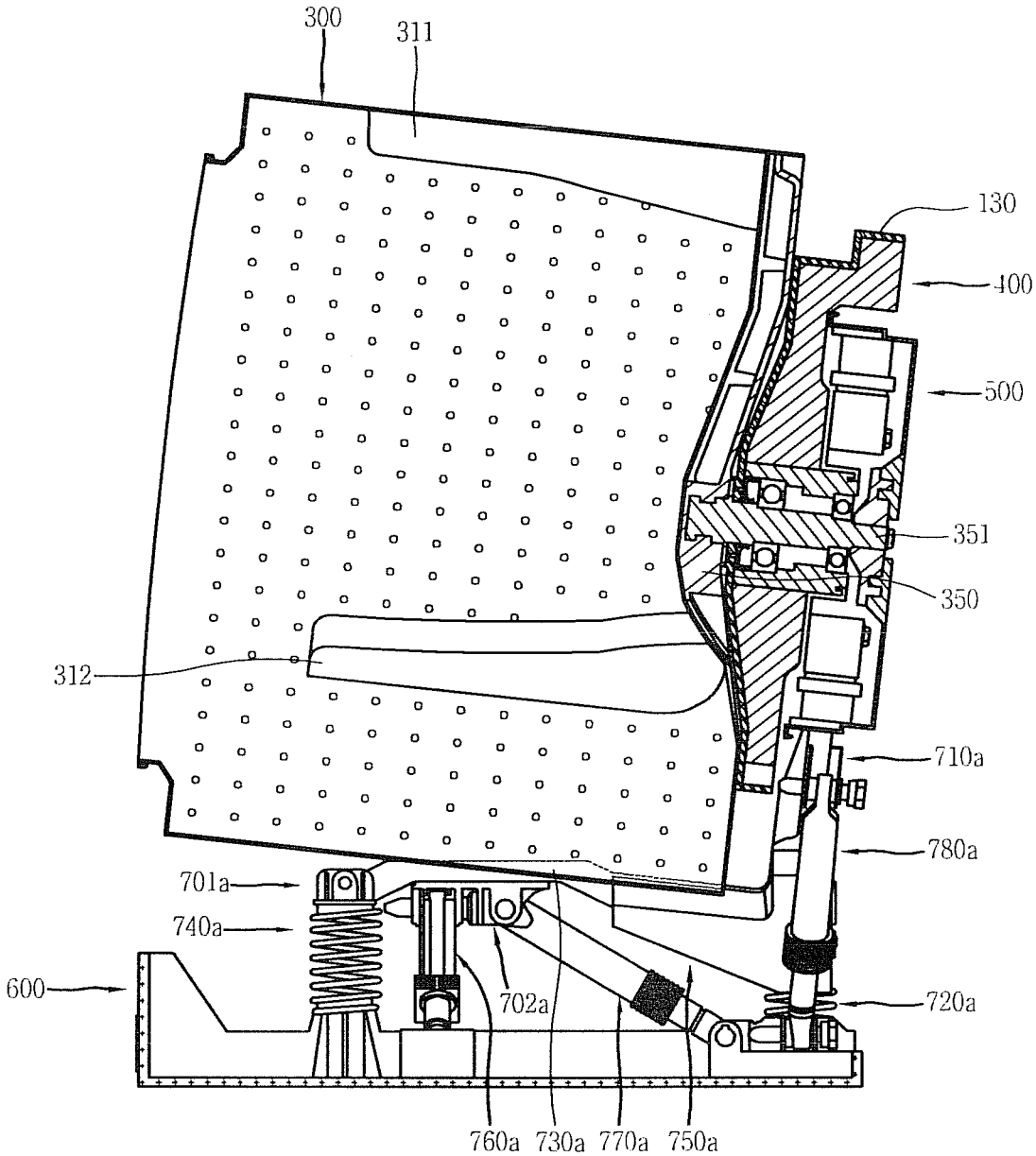
FIG. 2 is a side sectional view of a laundry treating apparatus in accordance with one embodiment as broadly described herein.
Figure 3:
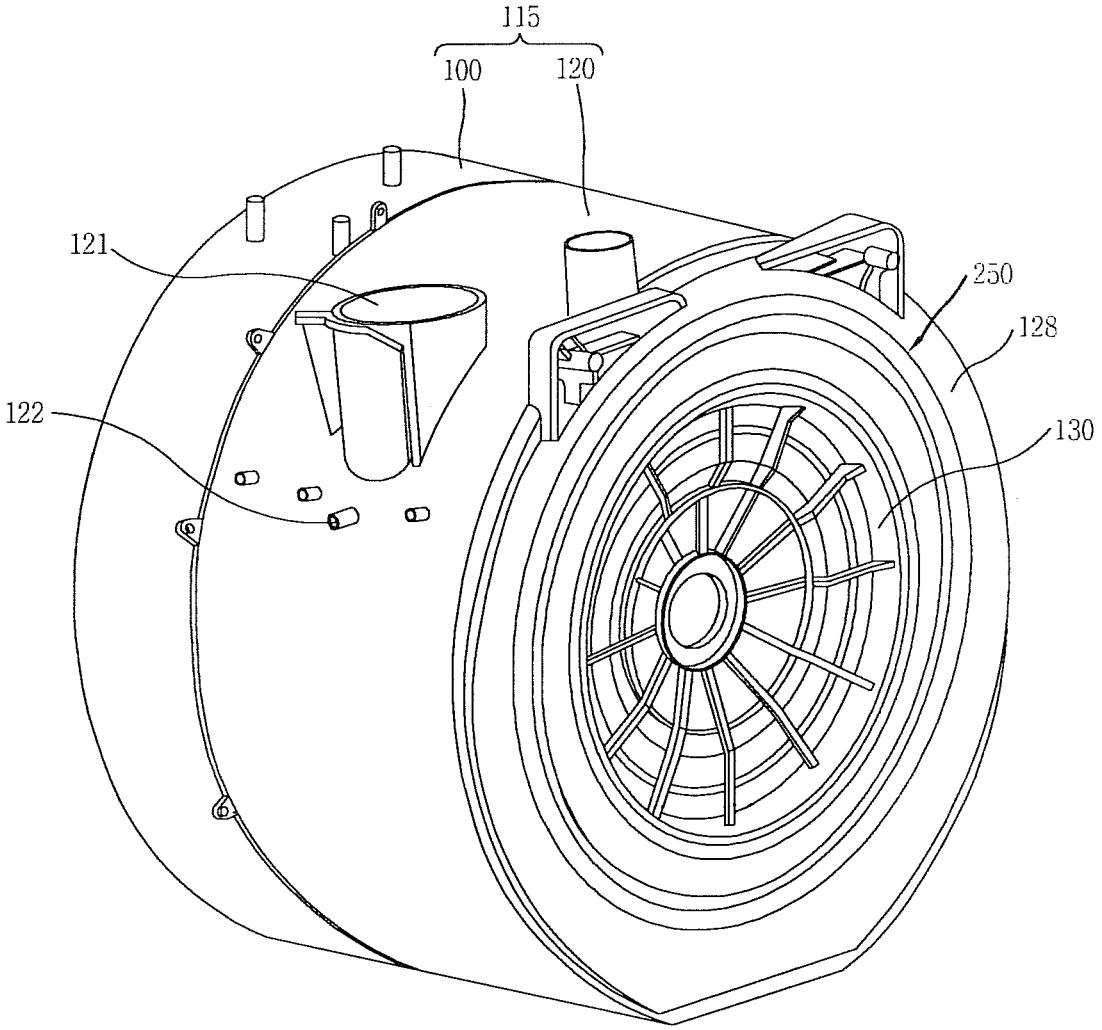
FIG. 3 is a perspective view of a tub and a rear gasket of the laundry treating apparatus shown in FIG. 2.

The weight 750*a* may be implemented such that its center of mass is biased toward the rear of the cabinet and an inner side of the cabinet. In detail, the weight 750*a*, as illustrated in FIG. 2, may be formed such that a portion thereof corresponding to the bent portion of the supporting member, namely, a portion corresponding to the connected portion between the first bracket 710*a* and the second bracket 730*a* is the thickest in and vertical direction and the thickness is reduced as it extends from the lower surface to the front side of the second bracket 730*a*. Also, the weight 750*a* may be formed such that a left-to-right thickness of a portion covering the right side wall 712 of the second bracket 730*a* is thicker than that of a portion covering the left side wall 711 of the second bracket. Such weights may balance the center of mass such that the drum 300 cannot be biased even though the clothes are introduced therein, and also function as a mass when the drum 300 is vibrated.

Figure 7:
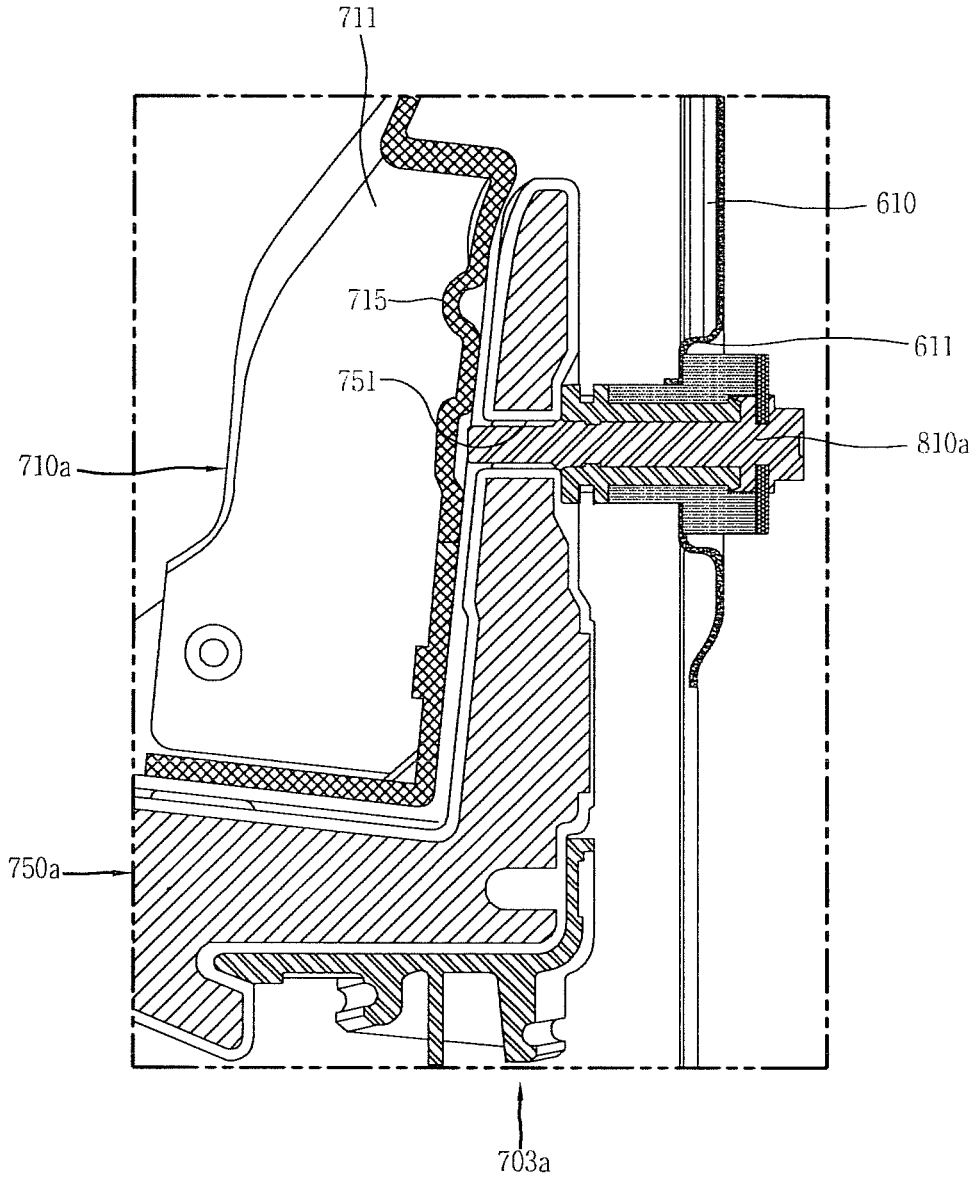
FIG. 7 is a sectional view taken along the line II-II of FIG. 4.

Referring to FIG. 7, the weight 750*a* may further include a through hole 751 for connecting the weight 750*a* to a rear surface 610 of the cabinet using a transit bolt 810*a*. The transit bolt 810*a* may extend through a bolt mounting portion 611, formed on the rear surface 610 of the cabinet, to the weight 750*a*, and have one end inserted into the through hole 751. The rear spring holder 703*a* for fixing the rear elastic member 720*a* may be fixed to a lower surface of the weight 750*a* by, for example, a bolt.

The rear spring holder 703*a* may include an upper portion having a through hole for coupling with the weight 750*a* by, for example, a bolt and one end bent up to correspond to a shape of the lower surface of the weight 750*a*, and a lower portion having a thread on an outer surface thereof such that the rear elastic member 720*a* may be inserted into and threadably coupled thereto. The lower portion of the rear spring holder 703*a* may have the same shape as the lower portion of the front spring holder 701*a*, so further description thereof will be omitted.

Figure 8:
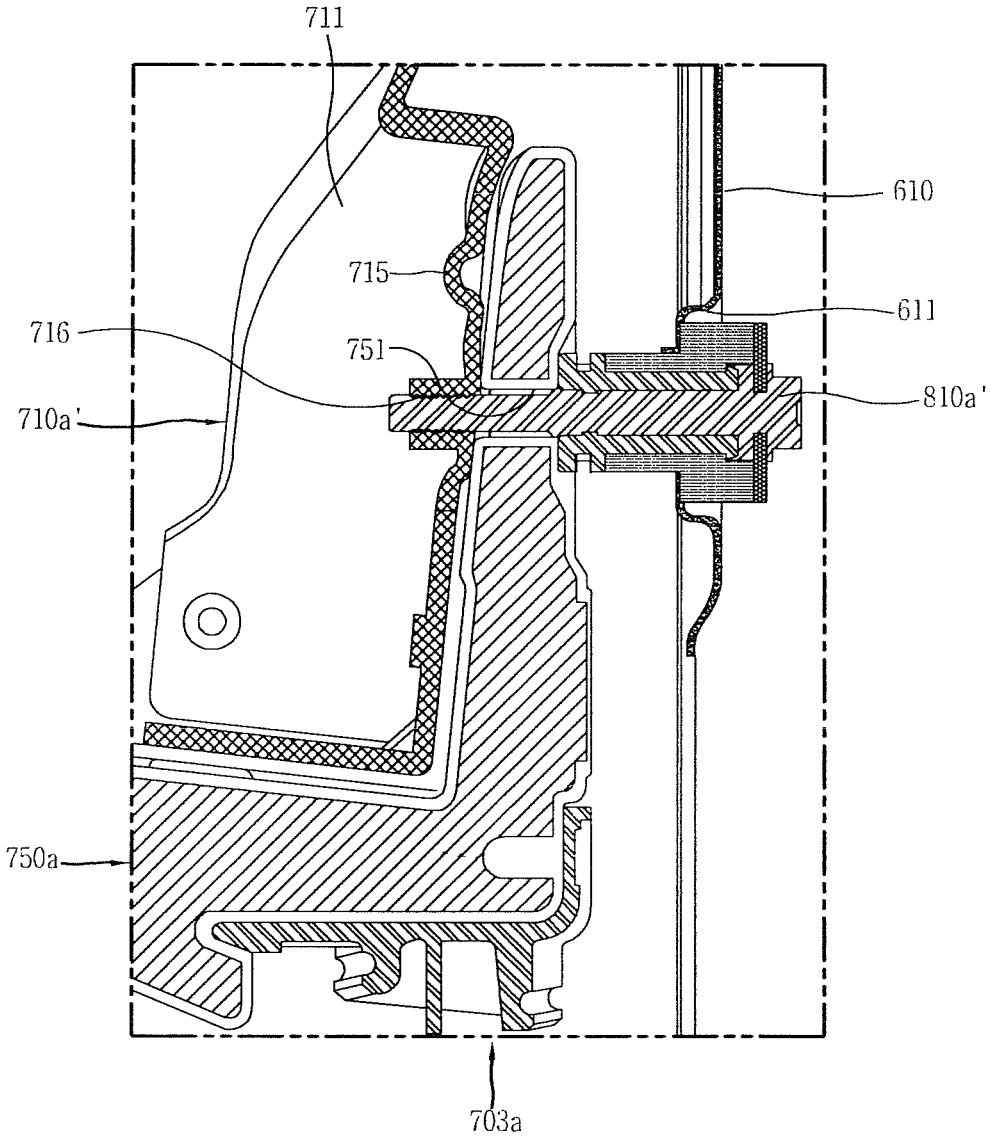
FIG. 8 is a side sectional view of a first bracket connected to a weight and a cabinet, in accordance with another embodiment as broadly described herein.

FIG. 8 is a side sectional view of a first bracket 710*a*' and a transit bolt 810*a*' coupled to the weight 750*a* in accordance with another exemplary embodiment. Referring to FIG. 8, the first bracket 710*a*' may further include a bolt coupling portion 716 having a thread on an inner surface thereof so as to be threadably coupled with one end of the transit bolt 810*a*'. The transit bolt 810*a*' may extend from the rear surface 610 of the cabinet through the through hole 751 of the weight 750*a*. The transit bolt 810*a*' may have one end threadably coupled to the bolt coupling portion 716 of the first bracket 710*a*'. The exemplary embodiment of FIG. 7 illustrates that the transit bolt 810*a* is coupled to the weight 750*a*, whereas the exemplary embodiment of FIG. 8 illustrates the transit bolt 810*a*' is also coupled to the first bracket 710*a* as well as the weight 750*a*, which may result in improvement of a supporting force.

A plurality of dampers may be implemented using various types of dampers capable of providing a damping force by frictional resistance, which is generated as a piston is moved within a cylinder. The plurality of dampers may further include a pair of first dampers 760*a* and 760*b* for reducing vibration of the drum generated in left and right directions, a pair of second dampers 770*a* and 770*b* for reducing vibration generated when the drum is rotated, and a pair of third dampers 780*a* and 780*b* for reducing vibration of the drum generated in up and down directions. A plurality of hinges 660*a*, 660*b*, 670*a*, 670*b*, 680*a* and 680*b* may be provided at the base 600 to connect a plurality of dampers 760*a*, 760*b*, 770*a*, 770*b*, 780*a* and 780*b* to the base 600, respectively.

The first dampers 760*a* and 760*b* may be located at a left side (760*a*) and a right side (760*b*) of the drum to be symmetrical to each other in right and left directions based on the vertical centerline defined by the provided rotation shaft of the drum 300. Similarly, the second dampers 770*a* and 770*b* and the third dampers 780*a* and 780*b* may also be disposed symmetrical to each other based on the rotation shaft of the drum 300. Therefore, hereinafter, description will be provided based on the plurality of dampers 760*a*, 770*a* and 780*a* which are located at the left-hand side of the drum 300.

The first damper 760*a* may generally reduce the vibration of the drum 300 generated in the left and right directions. The first damper 760*a* may extend inward and at an incline from the front end portion of the second bracket 730*a* toward the base 600. The first damper may couple to the base 600 by the hinge 660*a*. The first damper 760*a* may be located between the front elastic member 740*a* and the second damper 770*a*. An end portion of the first damper 760*a* connected to the second bracket 730*a* may be adjacent to the front elastic member 740*a*.

Referring to FIGS. 2 and 4, the first damper 760*a* may be disposed in a widthwise direction of the drum 300. A first angle θ1, which is an angle formed between the first damper 760*a* and a surface of the base 600, may be, for example, about 30°. The first angle θ1 is not limited to this, and may range from 30° to 60°. Also, when the third damper 780*a* is provided, the first angle θ1 may be within a range smaller than a third angle θ3, which is formed between the third damper 780*a* and the surface of the base 600.

The first damper 760*a* may apply a damping force which is weaker than that of the second damper 770*a*. For example, the first damper 760*a* may have a damping force of 40 N. The first damper 760*a* may also have the same damping force as the third damper 780*a* when the third damper 780*a* is also provided.

The second damper 770*a* may generally reduce the vibration generated when the drum 300 is continuously rotated. The second damper 770*a* may extend back and at an incline from the central portion of the second bracket 730*a* toward the base 600. Also, the second damper 770*a* may extend along a lengthwise direction of the drum 300. The second damper 770*a* may be disposed between the first damper 760*a* and the rear surface 610 of the cabinet. The rear surface 610 of the cabinet is illustrated in FIGS. 7 and 8. Referring to FIG. 2, the second damper 770*a* may be located between the first damper 760*a* and the rear elastic member 720*a*. In detail, an end portion of the second damper 770*a*, which is coupled to the second bracket 730*a* by the hinge, may be adjacent to the first damper 760*a*, and an end portion of the second damper 770*a*, which is coupled to the base 600 by the hinge 670*a*, may be adjacent to the rear elastic member 720*a*.

A second angle θ2, which is formed between the second damper 770*a* and the surface of the base 600, may be substantially the same as the first angle θ1. For example, the second angle θ2 may be about 30°. The second damper 770*a* may have a stronger damping force than the first damper 760*a*. The damping force of the second damper 770*a* may be in the range of 40 N to 80 N. For example, the second damper 770*a* may have a damping force of 80 N. As such, since the second damper 770*a* has the damping force stronger than the first damper 760*a*, the vibration transferred to the base 600 may be remarkably reduced, and the vibration of a ball balancer may also be reduced.

The third damper 780*a* may further be provided in another exemplary embodiment, and may generally reduce the up-and-down vibration when the drum 300 is rotated. The third damper 780*a* may extend at an incline from the first bracket 710*a* toward the base 600. An end portion of the third damper 780*a*, which is coupled to the base 600 by the hinge 680*a*, may be adjacent to the rear elastic member 720*a*.

The third angle θ3, which is formed between the third damper 780*a* and the base 600, may be about 65°. The third damper 780*a* may have a damping force weaker than the second damper 770*a*. The damping force of the third damper 780*a* may also be the same as that of the first damper 760*a*, for example, 40 N.

A laundry treating apparatus is provided which does not require a buffering member installed in a tub for reducing vibration, by virtue of preventing vibration generated in a driving device and a drum from being transferred to the tub.

A laundry treating apparatus is provided which has a simplified buffering member structure for reducing vibration while maintaining desired vibration reduction.

A laundry treating apparatus, as embodied and broadly described herein, may include a cabinet, a tub fixed to the cabinet and having a front portion communicating with an outer side of the cabinet, a drum received in the tub and rotatably connected to a rear portion of the tub, a driving unit having a bearing housing for rotatably supporting a rotation shaft connected to the drum and a driving motor for rotating the rotation shaft, a rear gasket configured to seal a rear portion of the tub to prevent a leakage of water from the tub to the driving unit and having flexibility for the driving unit to be relatively movable with respect to the tub, supporting members connected to the bearing housing and extending between a lower surface of the cabinet and the tub from a rear side of the tub, and a plurality of dampers installed between the supporting members and the lower surface of the cabinet.

The plurality of dampers may include first dampers inwardly extending from a front portion of the supporting members toward the lower surface of the cabinet, and second dampers downwardly extending from the supporting members toward the rear side of the cabinet.

The first damper may have a damping force weaker than that of the second damper.

An angle from the first damper to the lower surface of the cabinet may be the same as an angle from the second damper to the lower surface of the cabinet.

In accordance with another exemplary embodiment, the supporting members may include first brackets extending from the bearing housing toward the lower surface of the cabinet, and second brackets extending from the first brackets toward the front side of the cabinet. The first dampers may inwardly extend from a front portion of the first brackets toward the lower surface of the cabinet, and the second dampers may be disposed between the first dampers and a rear surface of the cabinet and downwardly extend from the second brackets toward the rear side of the cabinet.

The first and second brackets may include supporting walls formed on edges thereof in a press-molding manner. Also, at least one of the first and second brackets may include at least one bead extending along the extending direction of the bracket in a convex form.

The apparatus may further include weights mounted to at least one of the first brackets and the second brackets.

The apparatus may further include a pair of elastic members configured to support both end portions of the second brackets with respect to the lower surface of the cabinet.

The tub may include a tub back defining a rear surface thereof and secured with the bearing housing, and the rear gasket may hermetically seal a gap between the tub back and the rear portion of the tub.

In accordance with another exemplary embodiment, the plurality of dampers may further include third dampers extending from the rear portion of the supporting members toward the lower surface of the cabinet. Here, the third damper may extend from the first brackets.

The third damper may have a damping force weaker than that of the second damper.

The first damper and the third damper may have the same damping force.

An angle from the third damper to the lower surface of the cabinet may be greater than an angle from the first damper or the second damper to the lower surface of the cabinet.

At least one of the plurality of dampers may be installed adjacent to the elastic member.

In accordance with one exemplary embodiment, by preventing vibration from being transferred from a drum to a tub, the vibration of the tub may be reduced. This may eliminate the need for an interval between the drum and the tub which has been maintained to allow for movement of these components during vibration. Consequently, an outer surface of the tub may be located close to a cabinet, which may result in implementing a laundry treating apparatus with a larger capacity in the same size of cabinet.

Also, in accordance with one exemplary embodiment, dampers and springs with a simplified structure may be used to reduce the vibration of the drum, which may allow for reduction of fabricating costs and facilitation of maintenance.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet;

a tub fixed to the cabinet;

a drum rotatably installed in the tub;

a driving system coupled to the drum, including a bearing housing to rotatably support a rotation shaft connected to the drum, and a driving motor to rotate the rotation shaft;

a flexible rear gasket provided at a rear portion of the tub to seal the rear portion of the tub;

a plurality of supporting devices coupled to the bearing housing at a rear side of the tub and extending to beneath the tub, wherein the plurality of supporting devices include:

a plurality of first brackets coupled to the bearing housing and extending along a rear end of the tub toward a lower surface of the cabinet;

a plurality of second brackets coupled to the plurality of first brackets and extending beneath the tub toward a front side of the cabinet;

a plurality of front elastic members to elastically support front ends of the plurality of second brackets, respectively; and a plurality of rear elastic members to elastically support rear ends of the plurality of second brackets, respectively, and a plurality of dampers installed between the plurality of supporting devices and the lower surface of the cabinet, wherein the plurality of dampers include:

a plurality of first dampers extending inward from a front portion of the plurality of second brackets toward the lower surface of the cabinet in a right-left direction of the cabinet; and a plurality of second dampers provided between the plurality of first dampers and a rear surface of the cabinet, the plurality of second dampers extending downward from the plurality of second brackets toward the rear surface of the cabinet in a front-rear direction of the cabinet.

2. The apparatus of claim 1, wherein a damping force of each of the plurality of first dampers is less than a damping force of each of the plurality of second dampers.

3. The apparatus of claim 2, wherein an angle formed between each first damper and the lower surface of the cabinet is the same as an angle formed between each second damper and the lower surface of the cabinet.

4. The apparatus of claim 2, wherein the plurality of dampers further include:

a plurality of third dampers extending from the plurality of first brackets toward the lower surface of the cabinet in the right-left direction of the cabinet.

5. The apparatus of claim 4, wherein a damping force of each of the plurality of third dampers is less than the damping force of each of the plurality of second dampers.

6. The apparatus of claim 5, wherein an angle formed between each third damper and the lower surface of the cabinet is greater than an angle formed between each first damper and the lower surface of the cabinet or each second damper and the lower surface of the cabinet.

7. A laundry treating apparatus, comprising:

a cabinet;

a tub fixed to the cabinet;

a drum rotatably installed in the tub;

a driving system coupled to the drum to rotate the drum, the driving system including a bearing housing provided at a rear end of the tub and configured to rotatably support a rotation shaft connected to the drum, and a driving motor to rotate the rotation shaft;

first and second supporting devices coupled to the bearing housing at a rear of the tub and extending beneath the tub; and a plurality of dampers, including a first plurality of dampers installed between the first supporting device and a lower surface of the cabinet and a second plurality of dampers installed between the second supporting device and the lower surface of the cabinet, wherein the first and second supporting devices each includes:

a first bracket coupled to the bearing housing and extending along the rear end of the tub toward the lower surface of the cabinet;

a second bracket coupled to the first bracket and extending beneath the tub toward a front of the cabinet;

a front elastic member to elastically support a front end of the second bracket;

a rear elastic member to elastically support a rear end of the second bracket, and wherein the first and second plurality of dampers each includes:

a first damper extending inward from a front portion of the first bracket toward the lower surface of the cabinet in a right-left direction of the cabinet; and a second damper provided between the first damper and a rear surface of the cabinet and extending downward from the second bracket toward the rear side of the cabinet in a front-rear direction of the cabinet.

8. The apparatus of claim 7, wherein at least one of the first bracket or the second bracket includes a bead formed along a longitudinal direction thereof, and supporting walls formed along longitudinal edges thereof.

9. The apparatus of claim 7, further comprising:

a tub rear wall provided at the rear end of the tub, wherein the bearing housing is fixed to a rear side of the tub rear wall; and a flexible gasket provided between a circumferential edge of the tub and the tub rear wall to form a flexible seal therebetween.

10. The apparatus of claim 7, further comprising:

a weights coupled to at least one of the first bracket or the second bracket.

11. The apparatus of claim 7, wherein at least one of the plurality of dampers is installed adjacent to the front elastic member.

12. The apparatus of claim 7, wherein a damping force of the first damper less than a damping force of the second damper.

13. The apparatus of claim 7, wherein an angle formed between the first damper and the lower surface of the cabinet is the same as an angle formed between the second damper and the lower surface of the cabinet.

14. The apparatus of claim 7, wherein the first and second plurality of dampers each further includes:

a third damper extending from the first bracket toward the lower surface of the cabinet.

15. The apparatus of claim 14, wherein a damping force of the third damper is less than a damping force of the second damper.

16. The apparatus of claim 14, wherein an angle formed between the third damper and the lower surface of the cabinet is greater than an angle formed between the first damper or the second damper and the lower surface of the cabinet.

17. A laundry treating apparatus, comprising:

a cabinet;

a tub fixed in the cabinet, the tub being substantially cylindrical and having a front opening formed at a front axial end thereof and a rear opening formed at a rear axial end thereof;

a drum rotatably provided in the tub;

a tub back wall positioned in the rear opening of the tub;

a flexible gasket positioned between the tub back wall and an inner circumferential edge of the rear opening to flexibly seal the rear axial end of the tub;

a bearing housing coupled to a rear side of the tub rear wall, the bearing housing supporting a shaft that is connected between a motor and the drum to rotate the drum;

a plurality of supporting devices coupled to a rear side of the bearing housing, the plurality of supporting devices extending radially along the rear axial end of the tub and then axially beneath the tub; and a plurality of dampers coupled to each of the plurality of supporting devices and extending downward at an angle to lower surface of the cabinet, wherein the plurality of supporting devices include a first supporting device and a second supporting device symmetrically arranged on opposite sides of a vertical centerline defined by the shaft, wherein the first supporting device and the second supporting device each includes:

a first bracket having a first end thereof coupled to the bearing housing and extending radially outward along the rear axial end of the tub; and a second bracket having a first end thereof coupled to a second end of the first bracket and extending beneath the tub and forward toward the front axial end of the tub to a second end of the second bracket, wherein first and second elastic members are respectively provided beneath the first and second ends of the second bracket, between the second bracket and the lower surface of the cabinet, to elastically support the second bracket and first bracket coupled thereto, wherein the plurality of dampers includes a first plurality of dampers coupled to the first supporting device and a second plurality of dampers coupled to the second supporting device, wherein the first and second plurality of dampers each includes:

a first damper coupled to the second bracket, at a position proximate the second elastic member, and extending downward at an incline to the lower surface of the cabinet in a right-left direction of the cabinet; and a second damper coupled to the second bracket, at a position proximate the first elastic member, and extending downward at an incline to the lower surface of the cabinet in a front-rear direction of the cabinet.

18. The apparatus of claim 17, wherein the first and second plurality of dampers each further includes a third damper coupled to the first bracket, at a position proximate the first end thereof, and extending downward at an incline to the lower surface of the cabinet in the right-left direction of the cabinet.

* * * * *